United States Patent [19]

Gregory

[11] 4,337,717

[45] Jul. 6, 1982

[54] REVERSIBLE GRAPPLING ANCHOR

[76] Inventor: Clarence T. Gregory, 11 Pelham Heights, Anniston, Ala. 36201

[21] Appl. No.: 144,413

[22] Filed: Apr. 28, 1980

[51] Int. Cl.[3] ..... B63B 21/24; B63B 21/46

[52] U.S. Cl. ..... 114/294; 114/297

[58] Field of Search ..... 114/294, 297, 299, 301, 114/300, 310

[56] References Cited

U.S. PATENT DOCUMENTS

| | | | |
|---|---|---|---|
| 242,958 | 6/1881 | Moule | 114/301 |
| 1,617,528 | 2/1927 | Kucher | 114/300 |
| 2,161,906 | 6/1939 | Filby | 114/301 |
| 2,424,040 | 7/1947 | Long | 114/299 |
| 3,040,692 | 6/1962 | Hardy, Jr. | 114/301 |

FOREIGN PATENT DOCUMENTS

| | | | |
|---|---|---|---|
| 77875 | 1/1949 | Norway | 114/301 |

*Primary Examiner*—Sherman D. Basinger
*Attorney, Agent, or Firm*—A. W. Breiner

[57] ABSTRACT

An anchor which includes an anchoring head having slidably mounted relative thereto a frame which, in turn, carries a slip ring for the anchor cable. The anchor head includes a plurality of mud barbs joined by sand plates for firm anchoring in a bottom. The frame is generally triangular in outline and includes a sliding bar which is slidably mounted relative to the anchor head. The slip rings for the anchor cable is slidably mounted on one leg of a reversible bar of the frame, and has connected thereto a cable which has connected to its opposite end a float in such a manner that once the anchor has been positioned and the anchor cable has been slackened, the slip ring will be automatically pulled by the float from a position at the upper part of the frame to a position at the lower rear corner of the frame. A counter-weight is positioned at the lower rear corner of the frame and, if desired, may have a rearwardly extending spade for digging into the bottom. Further, the sliding bar may be provided with an auxiliary spade for digging into the bottom, the auxiliary spade being disposed adjacent the counter-weight.

8 Claims, 5 Drawing Figures

52
50
44
46
10
22
28
12
32
18
16
14
5
30
40
60
58
24
34
54
42
36
48
38
56
26
20

REVERSIBLE GRAPPLING ANCHOR

This invention relates in general to new and useful improvements in anchors for boats and the like; and, more particularly, to a reversible grappling anchor.

In accordance with this invention, the anchor includes an anchor head having a plurality of radiating and diverging mud barbs extending rearwardly therefrom with the mud barbs being joined by sand plates for firm anchoring into the bottom of a body of water. The anchor head has slidably connected thereto a generally triangular frame to which there is coupled an anchor cable. The relationship of the triangular frame, the anchor head, and the anchor cable is one wherein the anchor is lowered in a generally horizontal position; and after the anchor head digs into the bottom, the triangular frame slides rearwardly with respect thereto and digs in a spade at the rear end thereof.

One of the particular features of the anchor is the securement of the anchor chain to a downwardly and rearwardly sloping leg of the triangular frame by way of a slip ring. The slip ring has connected thereto a cable which has coupled to its opposite end a float and the cable being so related relative to the slip ring wherein once the anchor has settled and the anchor chain becomes slack, the float will pull the cable upwardly in a manner so as to pull the slip ring downwardly to the lower rear corner of the triangular frame.

Another feature of this invention is the position of a counter-weight on the rear of the triangular frame, both for the purpose of balancing the anchor and facilitating the rotation of the anchor when the anchor is being released so as to effect a pivoting of the anchor about the rear end thereof and to provide for the release of the anchor head from the bottom.

In accordance with this invention, the weight may be provided with a rearwardly extending spade portion for digging into the bottom, or a separately formed spade may be mounted on the triangular frame adjacent the weight. If desired, both spades could be utilized.

Having described the invention in general terms, specific and presently preferred embodiments will be set forth in the context of the illustrative drawing.

Figures 1, 2, 5:
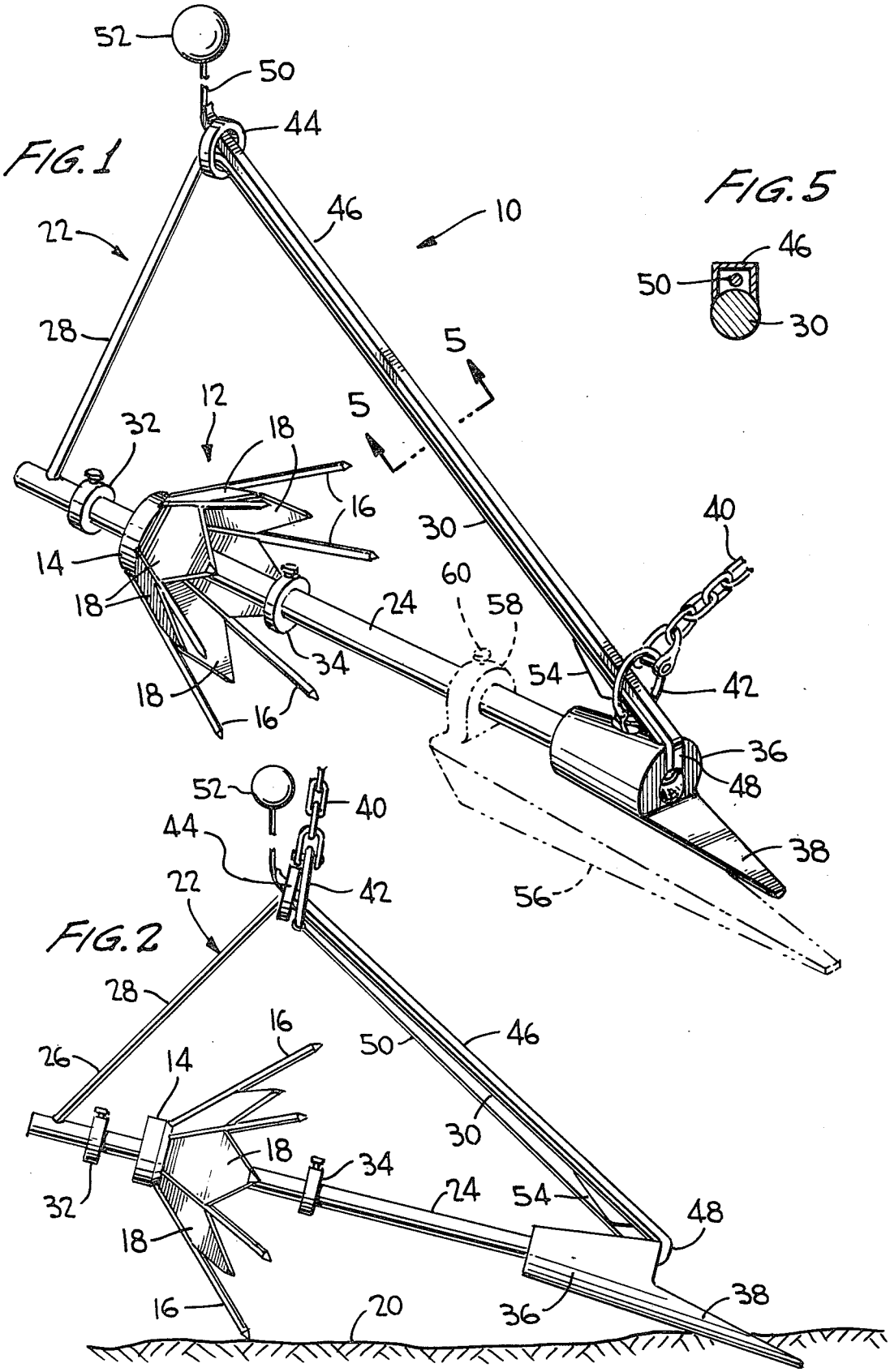
FIG. 1 is a perspective view of the anchor in position on the bottom.
FIG. 2 is a side elevational view of the anchor of FIG. 1 and shows the same as it is being set in the bottom.
FIG. 5 is an enlarged fragmentary transverse sectional view taken generally along the line 5—5 of FIG. 1, and shows the details of a guide for a slip ring positioning cable.

Referring to the drawing, the anchor is generally identified by numeral 10 and includes an anchor head generally identified by numeral 12. Anchor head 12 includes a tubular member 14 which has extending therefrom in circumferentially spaced relation a plurality of radially diverging mud barbs 16 joined together by sand plates 18. Although the number of mud barbs can vary, preferably there are six barbs uniformly spaced since this number, and in the evenly spaced configuration, facilitates the setting of the anchor head.

It will be readily apparent from the illustration of FIG. 1 that the anchor head 12 is suitable for digging into a bottom, such as the bottom 20 of FIG. 2, and being firmly anchored therein.

The anchor 10 also includes a generally triangular frame identified by the numeral 22. The frame 22 includes a lower sliding bar 24 and a reversing bar 26 which has an upwardly and rearwardly sloping front portion 28 and a downwardly and rearwardly sloping rear portion 30. The reversing bar 26 is suitably secured to opposite end portions of the sliding bar 24 as by welding.

It is to be noted that the sliding bar 24 freely slides through the tubular member 14 so that the anchor head 12 is rotatably mounted on the sliding bar 24 for both sliding movement and for rotational movement. The sliding bar 24 is provided with two adjustable stop collars 32, 34 to limit the sliding movement of the anchor head 12 on the sliding bar 24.

The sliding bar 24 also carries at the rear end thereof a counter-weight 36. Preferably the counter-weight 36 is provided with a rearwardly projecting spade 38 for digging into the bottom 20.

An anchor chain 40 is coupled to the triangular frame 22 by a slip ring 42 which is positioned on the rear portion 30 of the reversing bar 26. The slip ring 42 is retained on the rear portion 30 by a slip ring stop 44 disposed at the apex of the reversing bar 26. Movement of the slip ring 42 onto the sliding bar 24 is prevented by the weight 36.

The rear portion 30 of the reversing bar 26 has mounted on the upper surface thereof a cable guide 46 which extends the full length of the rear portion 30 and is reversibly turned as at 48 at the lower end of the rear portions 30 so as to extend generally parallel thereto and underneath the same without interfering with the connection of the rear end of the rear portion 30 to the sliding bar 24. A cable 50 extends through the guide 46, which is of an inverted channel-shape configuration, and has its rear or lower end anchored to the slip ring 42. The upper end of the cable 50 extends beyond the upper end of the guide 46 and is connected to a float 52.

The underside of the rear portion 30 is also provided with a wedge-shaped stop 54 for resisting movement of the slip ring 42 up the rear portion 30 of the reversing bar 26.

It is to be understood that the weight 36 is selected so as to generally balance the anchor 10 when the slip ring 42 is at the apex of the triangular frame 22. When the anchor 10 is lowered into the water, the anchor is generally horizontally disposed and the mud barbs 16 engaged to bottom 21 digging into the bottom to a limited extent. Then as the anchor chain 40 is further slackened, the triangular frame 22 will slide through the anchor head 12, with the spade 38 digging into the bottom. As the anchor chain 40 is further slackened, the float 52 will move upwardly and draw the slip ring 42 downwardly and rearwardly along the rear portion 30 and below the wedge 54 to the position of FIG. 3. At this time, the anchor chain 40 should have been paid out sufficiently so as to exert a pull on the rear corner of the triangular frame 22 at generally the angle shown in FIG. 3. This results in the spade 38 being dug firmly into the bottom at the same time as the mud barbs 16 and the sand plates 18 are also firmly dug into the bottom. It is to be noted that the sliding bar 24 has slid through the tubular member 14 until it is engaged with the front stop 32.

Figure 3:
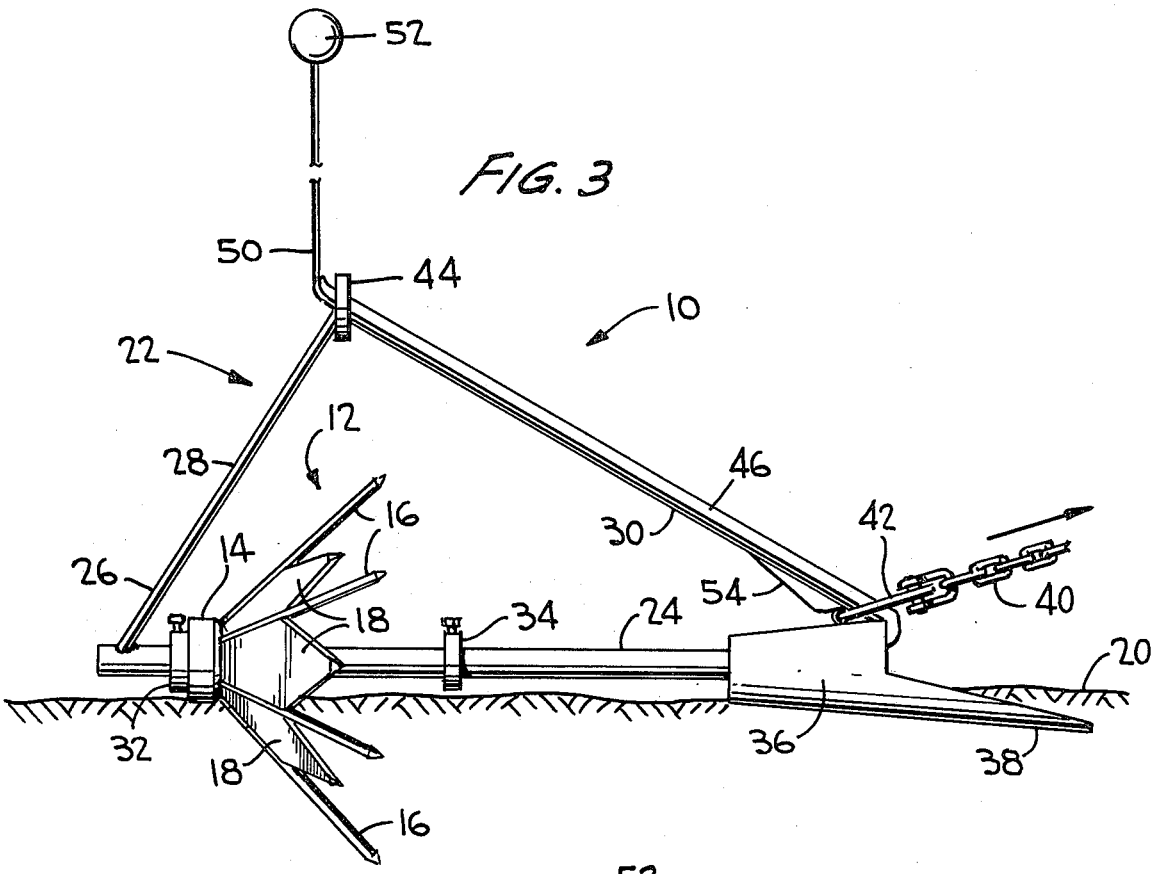
FIG. 3 is a side elevational view showing the anchor fully set in the bottom.

It will be readily apparent that when the anchor 10 is in the position of FIG. 3, it is well dug into the bottom 20 and provides for a much greater holding force than that which is available for anchors of other designs and like weight.

Figure 4:
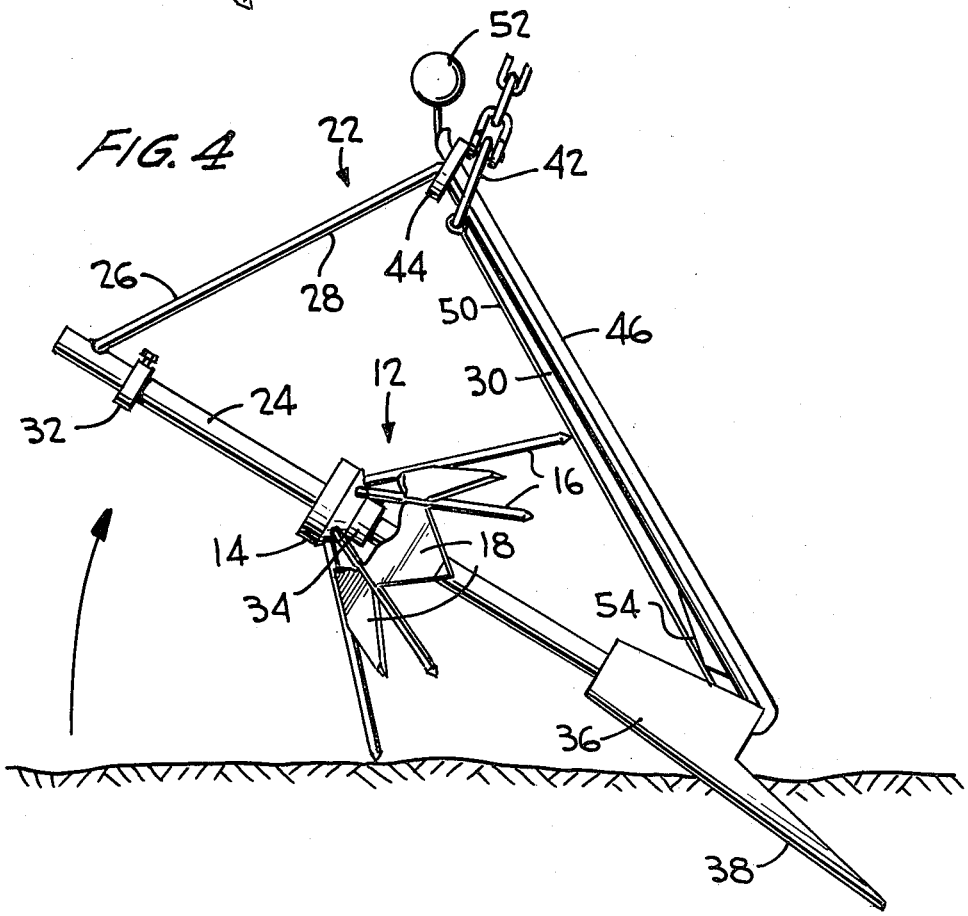
FIG. 4 is another side elevational view showing the anchor being withdrawn from the bottom.

When it is desired to release the anchor 10, the boat to which the anchor chain 40 is attached is moved forward until its connection with the anchor chain 40 is over the apex of the triangular frame 22. The anchor chain 40 is then once again tensioned with the result that the slip ring 42 will slide over the retaining wedge 54 and up the rear portion 30 of the reversing bar 26 until it engages the stop 44. At this time, further tensioning of the anchor chain 40 will result in the tilting of the anchor about the weight 36 or the spade 38, when such spade is provided, as is shown in FIG. 4. This will result in the gradual withdrawal of the mud barbs 16 and the sand plates 18 from the bottom with a gradual rotation of the anchor head 12, as shown in FIG. 4. Eventually the anchor head 12 will become entirely free from the bottom, at which time further tensioning of the anchor chain 40 will pull the spade 38 from the bottom and the anchor will be fully released.

It will be readily apparent that because of the tilting action of the anchor when it is being withdrawn from the bottom, as well as the sliding movement of the anchor head 12 on the sliding bar 24, the anchor 10, although it will have great holding power, may be readily removed from the bottom.

Returning once again to FIG. 1, it will be seen that there is illustrated in phantom lines a spade 56. The spade 56 is provided with a mounting sleeve 58 having a set screw 60 for fixing the same on the sliding bar 24 in the juxtaposition. It is to be understood that the spade 56 will function in the same manner as the spade 38 and may be used both in conjunction with the spade 38 or with a counter-weight 36 not provided with such a spade 38.

Although only a preferred embodiment of the anchor has been specifically illustrated and described herein, modifications and variations can be made without departing from the spirit and scope of the invention. Thus, as previously indicated, the number of barbs can vary. Additionally, it is not essential to employ sand plates 18. Rather, the barbs 16 can extend to tubular member 14. It has been found, however, that the use of barbs in combination with sand plates to provide a cuplike element permits an anchor which accommodates the different bottoms a boater is likely to encounter. The barbs will dig into a hard bottom and, therefore, are eminently advantageous with a hard bottom. The sand plates forming a cuplike element are eminently advantageous for a soft bottom where the cup will fill with or collect mud.

Moreover, as shown in the illustrated embodiment, the anchor head 12 is shown to move between members 32 and 34. The extent of movement of the head can be varied depending upon the bottom on which the anchor is to be used. Further, it is possible to fix anchor head 12 with members 32 and 34 so as to be stationary on member 24. When the anchor head is stationary, the anchor will be used primarily as a grappling hook. In positioning the anchor head along member 24, balance is important. If the head is stationary, the positioning should be behind the apex of the triangle for good setting and releasing characteristics. If the head is free to move, the balance should be adjusted depending upon conditions of use and type of bottom.

The essential advantages of the anchor of this invention include its increased ability to dig into any type of bottom. The greater the pull of a craft on the anchor line, the more the anchor will dig into the bottom. Because of its unique configuration, the anchor will hold in sandy, rocky, muddy, or a combination of bottoms. Even in deep, extremely soft mud the cup effect of the anchor will collect the mud and enhance its anchoring ability. Because of its superior anchoring ability, the anchor can be lighter and smaller than conventional anchors which depend largely upon weight and size for anchoring. The novel anchor assures quick and safe anchoring even in extremely swift water and does not permit excessive drifting even in swift water.

The variations as above stated and others, being within the spirit and scope of the invention, are to be covered by the appended claims.

It is claimed:

1. A reversible grappling anchor comprising an anchor head, bottom engaging means carried by said anchor head for interlocking engagement with a bottom of a body of water, a generally triangular frame including a lower sliding bar and an upstanding reversing bar connected to opposite ends of said sliding bar, said sliding bar being connected to said head for sliding movement therethrough, said reversing bar includes a front portion and a rear portion, and an anchor cable slip ring slidably mounted on said reversing bar rear portion for movement between an anchor support upper position and a tension applying lower position, and a float and cable assembly coupled to said slip ring for pulling said slip ring to said lower position when an associated anchor cable is slack.

2. An anchor according to claim 1 wherein a cable guide is carried by said reversing bar rear portion and is reversely turned at the lower end of said reversing bar rear portion for the exertion of a downward pull on said slip ring by said cable in response to an upward pull on said cable by said float.

3. A reversible grappling anchor comprising an anchor head, bottom engaging means carried by said anchor head for interlocking engagement with a bottom of a body of water, a generally triangular frame including a lower sliding bar and an upstanding reversing bar connected to opposite ends of said sliding bar, said sliding bar being connected to said head for sliding movement therethrough, and a counter-weight at the rear end of said frame to provide for rearward tilting of said frame during both the positioning of said anchor and the release thereof, said counter-weight having a rearward spade-like extension for digging into a bottom, and a rearwardly extending spade carried by said sliding bar adjacent said counter-weight and in overlapping relation to said counter-weight.

4. A reversible grappling anchor according to claim 1, and said reversible bar rear portion having adjacent to a lower end thereof on the underside thereof a slip ring retaining wedge having a stop surface facing said lower end.

5. A reversible grappling anchor according to claim 1, and said sliding bar having spaced stops therein on opposite sides of said anchor head for permitting and limiting sliding movement of said sliding bar relative to said anchor head.

6. A reversible grappling anchor comprising an anchor head, bottom engaging means carried by said anchor head for interlocking engagement with a bottom of a body of water, a generally triangular frame including a lower sliding bar and an upstanding reversing bar connected to opposite ends of said sliding bar, said sliding bar being connected to said head for sliding movement therethrough, said anchor head including a tubular member slidably mounted on said frame, and said bottom engaging means including a plurality of radially diverging barbs secured to said tubular member in circumferentially spaced relation and joined together by sand plates, said sand plates extending generally from said tubular member and being shorter than said barbs, and said sand plates having pointed ends remote from said annular member.

7. An anchor according to claim 6 wherein there is a counter-weight at the rear end of said frame to provide for forward tilting of said frame during both the positioning of said anchor and the release thereof, said counter-weight having a rearward spade-like extension for digging into a bottom.

8. An anchor according to claim 6 wherein there is a counter-weight at the rear end of said frame to provide for forward tilting of said frame during both the positioning of said anchor and the release thereof, and a rearwardly extending spade is slidably carried by said slide bar adjacent and forward of said counter-weight.

* * * * *